US007532832B2

(12) United States Patent
Hagiwara et al.

(10) Patent No.: US 7,532,832 B2
(45) Date of Patent: May 12, 2009

(54) IMAGE FORMING APPARATUS AND CHARGE CONTROL METHOD

(75) Inventors: Takuro Hagiwara, Kanagawa (JP); Yoshihisa Kitano, Kanagawa (JP); Osamu Handa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 140 days.

(21) Appl. No.: 11/652,003

(22) Filed: Jan. 11, 2007

(65) Prior Publication Data

US 2007/0189788 A1 Aug. 16, 2007

(30) Foreign Application Priority Data

Feb. 14, 2006 (JP) ..... 2006-036409

(51) Int. Cl.
*G03G 15/00* (2006.01)
*G03G 15/02* (2006.01)

(52) U.S. Cl. ..... 399/50; 399/26; 399/44; 399/176

(58) Field of Classification Search ..... 399/50, 399/44, 26, 176, 174, 168
See application file for complete search history.

(56) References Cited

U.S. PATENT DOCUMENTS 6,014,530 A * 1/2000 Tsunemi ..... 399/26 X
2002/0127027 A1* 9/2002 Kubota et al. ..... 399/44 X
2003/0219268 A1* 11/2003 Sunahara et al. ..... 399/50
2007/0127939 A1* 6/2007 Kitajima ..... 399/50
2007/0140714 A1* 6/2007 Kurita et al. ..... 399/44
2007/0189787 A1* 8/2007 Hagiwara et al. ..... 399/44

FOREIGN PATENT DOCUMENTS

JP 08-334956 A * 12/1996
JP 2002-062716 A * 2/2002
JP A-2004-333789 11/2004

OTHER PUBLICATIONS

Machine translation of JP 2004-333789 A dated Jul. 24, 2008.*

* cited by examiner

*Primary Examiner*—Sophia S Chen
(74) *Attorney, Agent, or Firm*—Morgan, Lewis & Bockius LLP

(57) ABSTRACT

An image forming apparatus includes a photoreceptor having on a surface thereof a photosensitive layer, in which an electrostatic latent image is formed, a contact charging roll applied with a bias containing a direct current component having superimposed thereon an alternating current component, the contact charging roll charging the photoreceptor to a predetermined potential, a film thickness detecting unit detecting a film thickness of the photosensitive layer of the photoreceptor, an environment detecting unit detecting environment, and a contact area changing unit changing a contact area between the contact charging roll and the photoreceptor based on detected results of the film thickness detecting unit and the environment detecting unit.

13 Claims, 4 Drawing Sheets

FIG. 4

| FILM THICKNESS (mm) | TEMPERATURE: 30°C/ HUMIDITY: 70°C | TEMPERATURE: 20°C/ HUMIDITY: 40°C | TEMPERATURE: 10°C/ HUMIDITY: 10°C |
|---|---|---|---|
| ≤ 15 | 300mm$^2$ (680gf) | 270mm$^2$ (580gf) | 270mm$^2$ (580gf) |
| ≤ 20 | 315mm$^2$ (900gf) | 300mm$^2$ (800gf) | 300mm$^2$ (750gf) |
| ≤ 25 | 315mm$^2$ (1000gf) | 315mm$^2$ (900gf) | 300mm$^2$ (850gf) |
| ≤ 30 | 330mm$^2$ (1100gf) | 330mm$^2$ (1100gf) | 315mm$^2$ (1000gf) |
| ≤ 40 | 330mm$^2$ (1200gf) | 330mm$^2$ (1200gf) | 330mm$^2$ (1200gf) |

IMAGE FORMING APPARATUS AND CHARGE CONTROL METHOD

CROSS-REFERENCE TO RELATED APPLICATIONS

This application is based on and claims priority under 35 USC 119 from Japanese Patent Application No. 2006-036409 filed Feb. 14, 2006.

BACKGROUND (1) Technical Field

The present invention relates to an image forming apparatus and charge control method by an electrophotographic system, and more particularly, it relates to such an image forming apparatus that has a photoreceptor having a prolonged service life and is prevented from suffering image defects due to wear of a photoreceptor, and a charge control method thereof.

(2) Related Art

In an image forming apparatus of a contact charging system, it is becoming a major target to prolong the service life of the photoreceptor, associated with demands of realizing a prolonged service life stably irrespective of environments, frequency of use and differences among lots.

SUMMARY

According to an aspect of the invention, there is provided an image forming apparatus including a photoreceptor that has on a surface thereof a photosensitive layer, in which an electrostatic latent image is formed, a contact charging roll that is applied with a bias containing a direct current component having superimposed thereon an alternating current component, and charges the photoreceptor to a predetermined potential, a film thickness detecting unit that detects a film thickness of the photosensitive layer of the photoreceptor, an environment detecting unit that detects environment, and a contact area changing unit that changes a contact area between the contact charging roll and the photoreceptor based on detected results of the film thickness detecting unit and the environment detecting unit.

BRIEF DESCRIPTION OF THE DRAWINGS

An exemplary embodiment of the invention will be described in detail based on the following figures, wherein:

FIG. 4 is a diagram showing an example of a contact area database according to the exemplary embodiment of the invention.

DETAILED DESCRIPTION

An exemplary embodiment of the invention will be described below with reference to the drawings.

Figure 1:
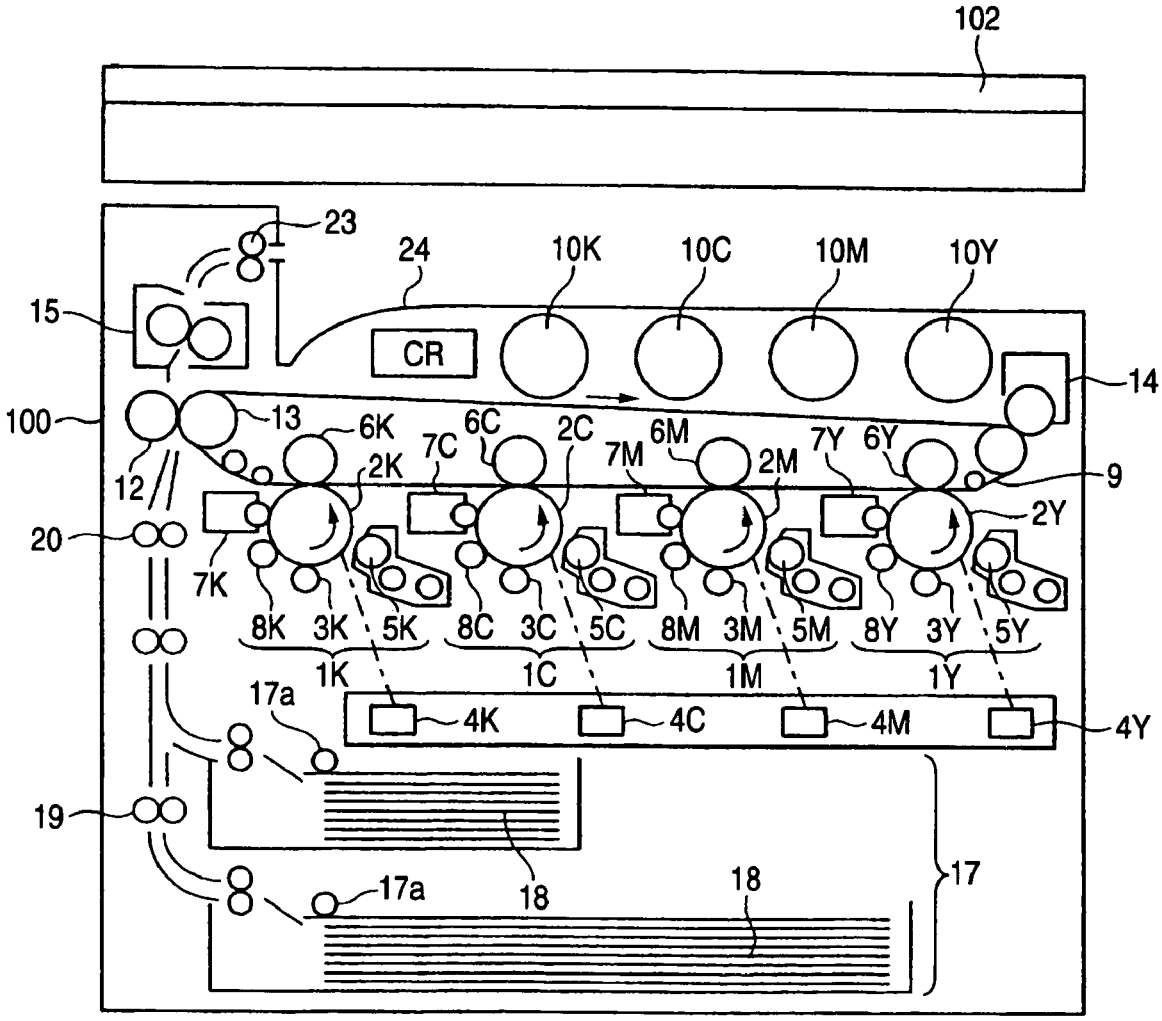
FIG. 1 is a schematic constitutional view showing an exemplary embodiment of an image forming apparatus according to the invention.

A schematic constitution of an image forming apparatus according to an exemplary embodiment of the invention will be described with reference to FIG. 1. FIG. 1 is a schematic constitutional view showing a tandem color image forming apparatus 100 according to the exemplary embodiment of the invention.

In the image forming apparatus 100, color image information of a color image read with an image reading device 102 or color image information sent from a personal computer or an image data input device, which is not shown in the figure, input, and the image information thus input is subjected to image processing.

In FIG. 1, symbols 1Y, 1M, 1C and 1K denote image forming units for forming toner images of yellow (Y) , magenta (M), cyan (C) and black (K) colors, respectively, and are disposed in line along an intermediate transfer belt 9 mounted on plural tension rolls in the order of 1Y, 1M, 1C and 1K in the transporting direction thereof. The intermediate transfer belt 9 is an intermediate transfer material, on which toner images of respective colors formed sequentially in the image forming units 1Y, 1M, 1C and 1K are accumulated and transferred, and is capable of circularly moving in the direction shown by the arrow and of passing between photoreceptor drums 2Y, 2M, 2C and 2K as electrostatic latent image carrying members corresponding to the image forming units 1Y, 1M, 1C and 1K and first transfer rolls 6Y, 6M, 6C and 6K disposed to face the photoreceptor drums 2Y, 2M, 2C and 2K, respectively. The toner images of respective colors thus transferred and accumulated on the intermediate transfer belt 9 are then transferred at once to recording paper 18 as a recording medium fed from a paper feeding cassette 17 and, thereafter fixed to the recording paper 18 with a fixing device 15, followed by discharging the recording paper 18 having a color image formed thereon to an exterior of the apparatus. Symbol CR denotes an apparatus controller that contains CPU, ROM, RAM and the like, and controls totally the operations in the image forming apparatus 100.

The image reading device 102 herein is constituted in such a manner that an original placed on a glass platen is irradiated with a light source, which is not shown in the figure, an a reflected light image from the original is read at a predetermined resolution through a scanning optical system with an image reading element containing a CCD sensor.

The image forming units 1Y, 1M, 1C and 1K are produced to have the same constitution, and each of them is constituted roughly by a photoreceptor drum 2Y, 2M, 2C or 2K that rotates in the direction shown by the arrow at a predetermined rotation speed, a charging roll 3Y, 3M, 3C or 3K as a charging unit that charges uniformly the surface of the photoreceptor drum 2Y, 2M, 2C or 2K, an exposing device 4Y, 4M, 4C or 4K that exposes the surface of the photoreceptor drum 2Y, 2M, 2C or 2K in the form of an image corresponding to the respective colors to form an electrostatic latent image, a developing device 5Y, 5M, 5C or 5K that develops the electrostatic latent image formed on the photoreceptor drum 2Y, 2M, 2C or 2K, a toner cartridge 10Y, 10M, 10C or 10K that is detachably disposed and feeds a toner of the corresponding color to the developing device 5Y, 5M, 5C or 5K, a destaticizing device 8Y, 8M, 8C or 8K, and a cleaning device 7Y, 7M, 7C or 7K.

In this exemplary embodiment, the photoreceptor drum 2Y, 2M, 2C or 2K contains a metallic drum rotating in the direction shown by the arrow, and coated on the surface thereof, a photosensitive layer containing an organic photosensitive material, an amorphous selenium photosensitive material or an amorphous silicon photosensitive material, and the charging roll 3Y, 3M, 3C or 3K is made in contact with the surface of the photoreceptor drum 2Y, 2M, 2C or 2K to charge the photosensitive layer to a predetermined potential with a bias containing a direct current component and an alternating current component superimposed thereon.

The image forming process in the image forming apparatus thus constituted as described above will be described with reference to the image forming unit 1Y forming a yellow toner image as a representative example.

The photoreceptor drum 2Y is uniformly charged on the surface thereof (photosensitive layer) by applying a bias containing a predetermined direct current component and an alternating current component superimposed thereon with the charging roll 3Y. The photosensitive layer is then subjected to scanning exposure corresponding to a yellow image with a laser beam output from the exposing device 4Y based, for example, on image information read by the image reading device 102, so as to form an electrostatic latent image corresponding to the yellow image on the surface (photosensitive layer) of the photoreceptor drum 2.

The electrostatic latent image corresponding to the yellow image is developed to a yellow toner image with the developing device 5Y and then first transferred onto the intermediate transfer belt 9 with a pressure force and an electrostatic attraction force of the first transfer roll 6Y constituting a part of a first transferring unit. The yellow toner remaining on the photoreceptor drum 2Y after the first transferring step is scraped out with the drum cleaning device 7Y. Thereafter, the surface of the photoreceptor drum 2Y is destaticized with a destaticizing device 8Y and then again charged with the charging roll 3Y for the next image formation cycle.

In the image forming apparatus 100 forming a color image with multiple colors, the similar image forming process as above is carried out also in the image forming units 1M, 1C and 1K at timings decided in consideration of the positional relationship of the image forming units 1Y, 1M, 1C and 1K, and a full color toner image obtained by accumulating the toner images is formed on the intermediate transfer belt 9. The intermediate transfer belt 9 is, for example, an endless belt formed with a flexible synthesis resin film strip, such as polyimide, both ends of which are connected by such a measure as welding.

The full color image thus first transferred to the intermediate transfer belt 9 is second transferred to the recording paper 18 transported to a second transfer position at a predetermined timing with a pressure force and an electrostatic attraction force of a backup roll 13 supporting the intermediate transfer belt 9 and a second transfer roll 12, which is in contact under pressure with the backup roll 13 at a predetermined timing.

The recording paper 18 having a predetermined dimension is fed with a paper feeding roll 17*a* from the paper feeding cassette 17 as a recording paper housing part disposed in the lower part of the image forming apparatus 100. The recording paper 18 thus fed is transported to the second transfer position of the intermediate transfer belt 9 at a predetermined timing with plural transporting rolls 19 and resist rolls 20. Onto the recording paper 18, the full color toner image is transferred at once from the surface of the intermediate transfer belt 9 with the backup roll 13 and the second transfer roll 12 as the second transferring unit.

The recording paper 18 having the full color image thus second transferred from the intermediate transfer belt 9 is separated from the intermediate transfer belt 9 and then transported to the fixing device 15 disposed on the downstream side of the second transferring unit. In the fixing device 15, the toner image is fixed on the recording paper 18 with heat and pressure. The recording paper 18 after subjecting to fixing is discharged to a paper delivery tray 24 through paper delivery rolls 23.

The residual toner remaining on the intermediate transfer belt 9 but not transferred to the recording paper 18 with the second transferring unit is transported in the state where the toner is attached to the intermediate transfer belt 9, to the belt cleaning device 14, and is then removed from the intermediate transfer belt 9 with the belt cleaning device 14 to prepare for the next image formation.

In the image forming apparatus having the aforementioned constitution, electric discharge occurs between the charging rolls 3Y, 3M, 3C and 3K and the photoreceptor drums 2Y, 2M, 2C and 2K corresponding thereto respectively upon applying a bias to the charging rolls 3Y, 3M, 3C and 3K, and the photoreceptor drums 2Y, 2M, 2C and 2K are charged to a predetermined potential with the discharge.

In the case where the alternating current component of the bias is increased upon applying the bias, the surface of the photoreceptor suffers damages, such as flaws, due to the amplitude of the alternating current component, so as to accelerate wear of the photoreceptor drums 2Y, 2M, 2C and 2K, which brings about deterioration in service life of the photoreceptor drums.

In the case where the alternating current component of the bias is decreased, on the other hand, charging failure occurs in the form of spots, which brings about image defects in the form of white spots.

The surface potential of the photoreceptor drum 2 is determined by the direct current bias (direct voltage and current). Specifically, the surface potential of the photoreceptor drum 2 is increased with increase of the alternating current bias (alternating voltage and current) until the alternating current bias reaches an amplitude of about twice the discharge starting voltage derived from the Paschen's Law, and when the alternating current bias exceeds about twice the discharge starting voltage, the surface potential of the photoreceptor drum 2 converges with a potential (constant potential) that is substantially equivalent to the direct current bias applied.

It has been found that the appropriate alternating current bias value, which is for preventing the photoreceptor from suffering wear due to application of an excessive alternating current bias and for preventing image defects from occurring due to application of an insufficient alternating current bias, is a value obtained by multiplying the alternating bias voltage/current value when the surface potential of the photoreceptor drum 2 converges with a potential substantially equivalent to the direct current bias (hereinafter, which is referred to as a saturation alternating current standard value in some cases), by a predetermined correction value.

Furthermore, it has been found through investigations made by the inventors that the alternating current bias value where the direct current bias is saturated (saturation alternating current standard value) shows a correlation with the contact area between the charging roll 3 and the photoreceptor drum 2, and the capacitance of the surface of the photoreceptor drum 2 is increased and decreased according to increase and decrease of the contact area to increase and decrease the saturation alternating current standard value.

Figure 3:
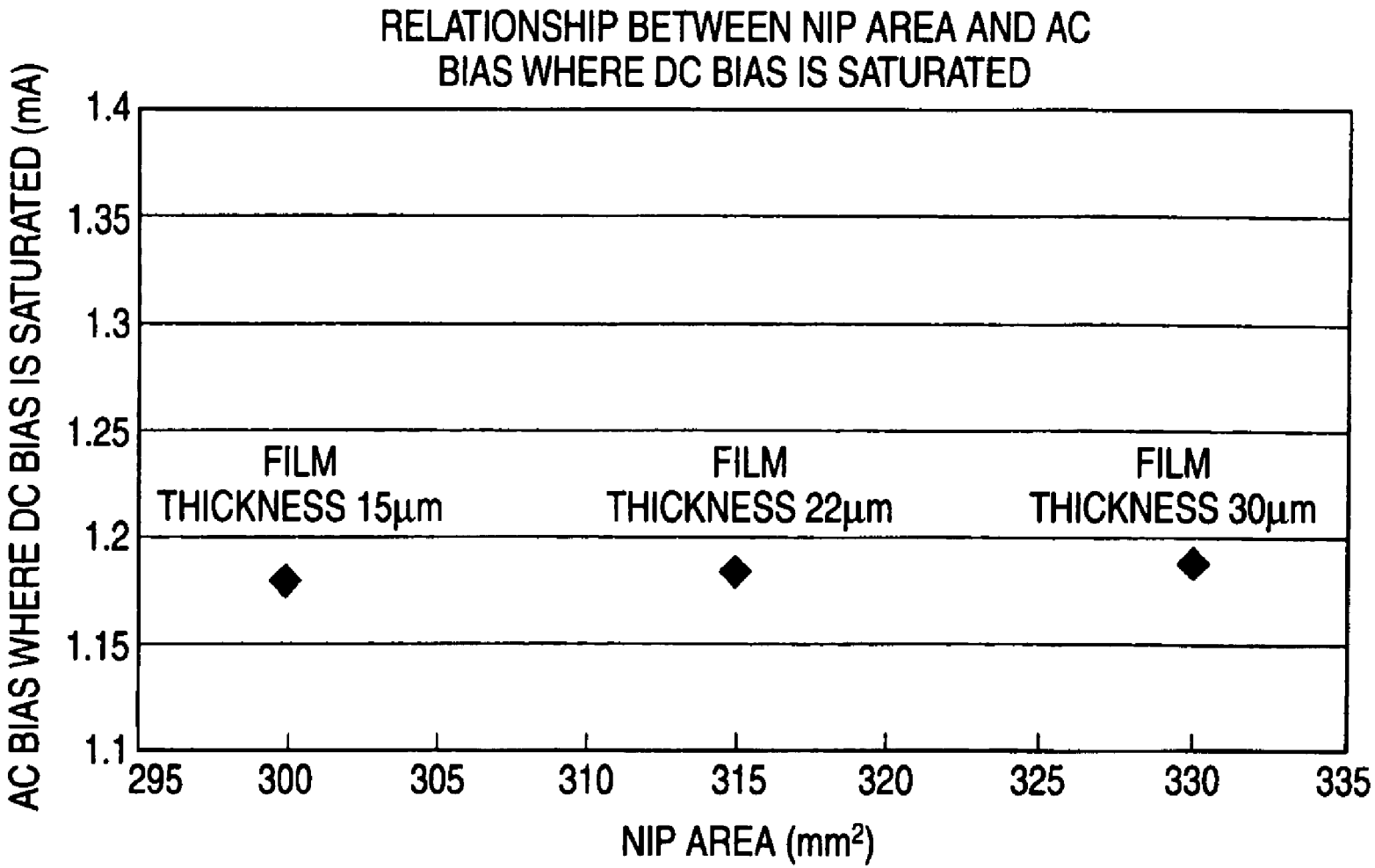
FIG. 3 is a graph showing a relationship between the nip area and the AC bias where the DC bias is saturated.

In general, it is known that the saturation alternating current standard value is increased with decrease of the film thickness, and wear of the photoreceptor drum 2 is accelerated with the bias based on the increased saturation alternating current standard value. It has now been found that the saturation alternating current standard value can be maintained constant by changing the nip area between the charging roll 3 and the photoreceptor drum 2 corresponding to the film thickness, as shown in FIG. 3.

In the image forming apparatus according to the exemplary embodiment of the invention, accordingly, the contact area between the photoreceptor drum 2 and the charging roll is changed corresponding to the film thickness of the photoreceptor and the environmental temperature and humidity, so as to maintain constant the saturation alternating current standard value. According to the constitution, an AC application process, which has been used for detecting the saturation alternating current standard value, is omitted, so as to suppress the photoreceptor drum 2 from suffering unnecessary wear and to prevent image defects from occurring, and simultaneously the charge control operation is simplified.

Figure 2:
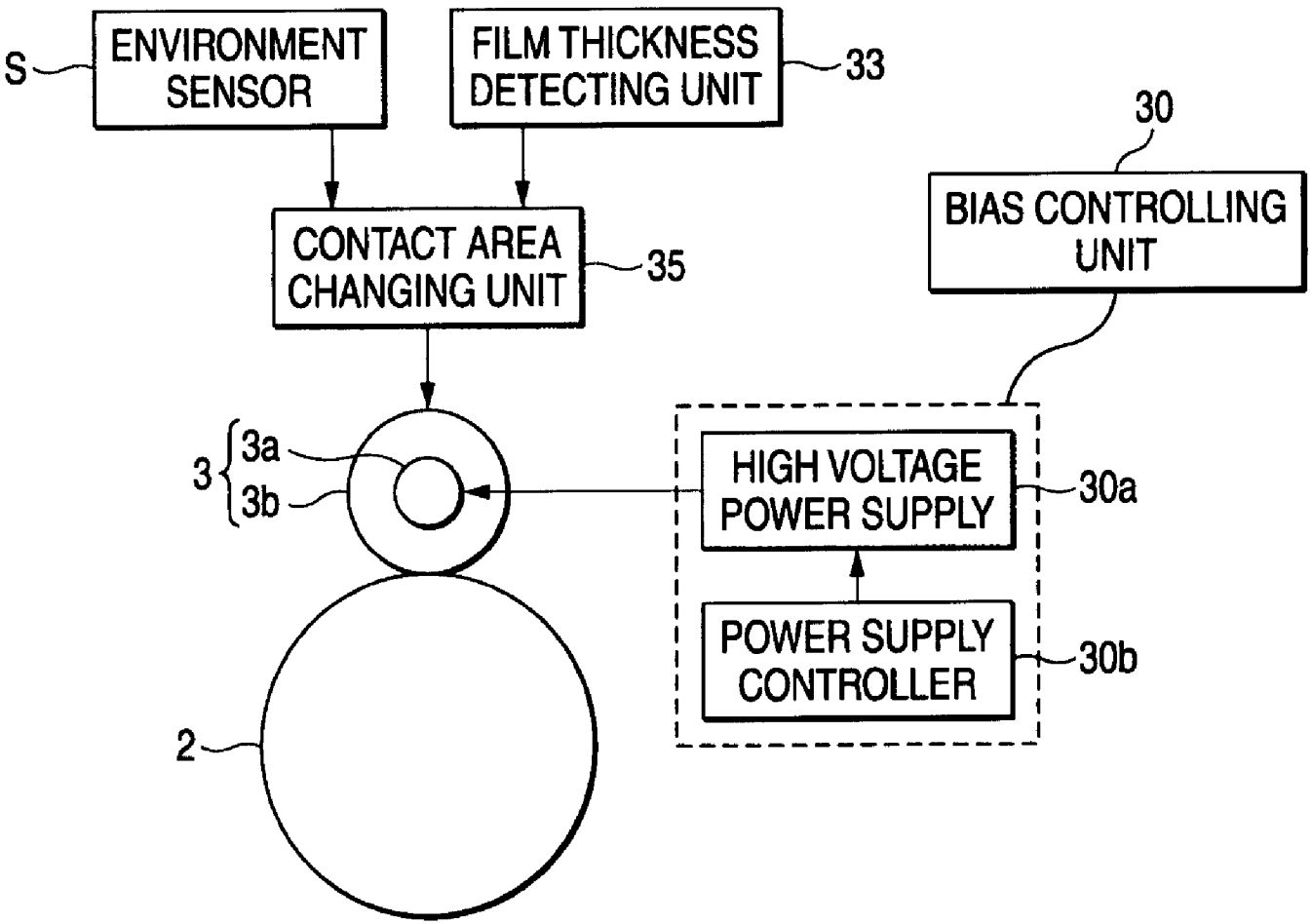
FIG. 2 is a block diagram schematically showing a constitution of charge control according to the exemplary embodiment of the invention.

The charge control operation in the image forming apparatus having the aforementioned constitution according to the exemplary embodiment of the invention will be described with reference to FIG. 2. FIG. 2 is a block diagram schematically showing a constitution of charge control according to the exemplary embodiment of the invention. The image forming units 1Y to 1K have the similar constitution, and the constitutional devices thereof (such as the photoreceptor drums 2Y to 2K) also have the similar structures. Accordingly, the symbols therefor is referred by the generic symbol (such as the photoreceptor drum 2) for simplification.

As shown in FIG. 2, the image forming apparatus according to this exemplary embodiment of the invention contains a contact charging roll 3 applying a predetermined bias to a surface of a photoreceptor drum 2 through contact therewith, a bias controlling unit 30 containing a high voltage power supply 30*a* supplying a bias to the charging roll 3 and a power supply controller 30*b* controlling the voltage and current supplied by the high voltage power supply 30*a*, an environment sensor S detecting the temperature and humidity in the apparatus, a film thickness detecting unit 33 detecting the film thickness of the photoreceptor drum 2, and a contact area changing unit 35 changing and controlling the contact area between the charging roll 3 and the photoreceptor drum 2 based on output of the environment sensor S and the film thickness detecting unit 33, so as to maintain constant the saturation alternating current standard value. As the environment sensor S, an ordinarily known temperature and humidity sensor may be used.

The charging roll 3 is constituted by a core metal 3*a* formed of a metal, such as stainless steel, having coated thereon a conductive layer 3*b* formed of a conductive synthetic resin or synthetic rubber, which is controlled to have a predetermined resistance value, and a releasing layer is formed on the surface of the conductive layer 3*b* depending on necessity. The core metal 3*a* is applied, for example, with an alternating current voltage having a direct current voltage superimposed thereon from the high voltage power supply 30*a*, whereby gap discharge is formed in the minute gap between the charging roll 3 and the photoreceptor drum 2, and the surface of the photoreceptor drum 2 is uniformly charged with the discharge.

In this exemplary embodiment, the voltage applied to the charging roll 3 contains a direct current bias voltage having an alternating current bias voltage superimposed thereon, and specifically a direct current bias voltage of from DC −800 to −700 V, which is substantially equivalent to the charge potential of the photoreceptor drum 2, and an alternating current bias voltage of from AC 1.5 to 2.5 kV with a frequency of from 1.3 to 1.5 kHz are set.

The film thickness detecting unit 33 in this exemplary embodiment simply detects the film thickness of the photoreceptor without application of an alternating current component to the photoreceptor drum 2 upon detecting the film thickness thereof, and the process of applying an alternating current bias voltage for detecting the film thickness is omitted thereby to suppress effectively the photoreceptor drum 2 from suffering wear.

More specifically, it is possible that only a DC bias is applied to the photoreceptor drum 2 upon detecting the film thickness, and the charge amount thereon is detected to obtain a ratio thereof with respect to the initial charge amount, which is then multiplied on the initial film thickness to detect (calculate) simply the film thickness in the use condition. In alternative, the film thickness may be simply detected (calculated) based on the relationship of the film thickness with respect to the measurement result of the printed sheet number counter or the accumulated rotation number counter of the photoreceptor drum 2, which has been known.

A film thickness sensor or a film thickness detecting cycle, which has been known, may also be separately provided as the film thickness detecting unit 33 for detecting the film thickness of the photoreceptor drum 2.

The contact area changing unit 35 in the exemplary embodiment of the invention changes and controls the contact area between the charging roll 3 and the photoreceptor drum 2 based on output of the environment sensor S and the film thickness detecting unit 33, so as to maintain constant the saturation alternating current standard value, and specifically, the contact area changing unit 35 presses the charging roll 3 onto the photoreceptor drum 2 at a predetermined contact load, and changes the contact load to realize a predetermined contact area.

Upon controlling the contact area to maintain constant the saturation alternating current standard value, the image forming apparatus of this exemplary embodiment has a contact area database (such as a table or a graph) providing the relationship of the contact area with respect to the film thickness and the environmental temperature and humidity as shown in FIG. 4 and a predetermined correction value database for obtaining an optimum alternating current bias for preventing image defects from occurring and for suppressing the photoreceptor drum 2 from suffering wear.

In the contact area database herein, the relationship between the contact area (contact load) and the film thickness of the photoreceptor within the predetermined charge range of the photoreceptor drum 2 (for example, from DC −800 to −700 V) is obtained in each range of use environment (temperature and humidity) predetermined. In the correction value database herein, the bias correction value for obtaining the optimum alternating current bias by multiplying it on the saturation alternating current standard value is obtained corresponding to the film thickness and the environmental temperature and humidity.

The contact area changing unit 35 changes the contact load for pressing the charging roll 3 onto the photoreceptor drum 2 by referring to the contact area database based on the detection result of the environment sensor S and the film thickness detecting unit 33, so as to realize such a contact area that maintains constant the saturation alternating current standard value.

In general, the saturation alternating current standard value is increased with decrease of the film thickness of the photoreceptor. However, the contact area (contact load) is decreased with the contact area changing unit 35, whereby the increment of the saturation alternating current standard value can be cancelled to maintain the value thereof constant, and thereby the photoreceptor drum 2 can be efficiently suppressed from suffering wear. Furthermore, the contact load is decreased, whereby the photoreceptor drum 2 can be suppressed from suffering mechanical wear due to contact with the charging roll 3.

Thereafter, the bias controlling unit 30 obtains the optimum alternating current bias by referring to the correction value database based on the saturation alternating current standard value thus maintained constant by the contact area changing unit 35, and applies a bias containing the direct current bias with the optimum alternating current bias superimposed thereon to the charging roll 3.

The controlling functions of the constitutional units may be realized with the apparatus controller CR or may be realized by providing separately exclusive controllers.

As having been described, in the image forming apparatus according to this exemplary embodiment, the contact area changing unit 35 maintains constant the saturation alternating current standard value by referring to the contact area database corresponding to the environmental temperature and humidity and the film thickness, and the bias controlling unit 30 applies such an optimum bias capable of preventing image defects from occurring and of suppressing the photoreceptor drum 2 from suffering wear, whereby an additional AC application process for setting the alternating current bias, which has been conventionally required, may not be provided, and the stress on the photoreceptor drum 2 can be decreased to prolong the service life of the photoreceptor drum 2.

The contact area changing unit 35 maintains constant the saturation alternating current standard value by referring to the contact area database, and simultaneously the bias controlling unit 30 sets and applies the optimum alternating electric current bias by referring to the correction value database based on the saturation alternating current standard value thus maintained constant, whereby the charge control operation can be significantly simplified as compared to the conventional complicated charge control for obtaining the AC bias where the DC bias is saturated.

Although the contact area making the saturation alternating current standard value constant is realized by changing the contact load in this exemplary embodiment, the invention is not limited to the exemplary embodiment, but the predetermined contact area may be realized by changing the center distance between the axes of the charging roll 3 and the photoreceptor drum 2.

The foregoing description of the exemplary embodiments of the invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a photoreceptor that has on a surface thereof a photosensitive layer, in which an electrostatic latent image is formed;

a contact charging roll that is applied with a bias containing a direct current component having superimposed thereon an alternating current component, and charges the photoreceptor to a predetermined potential;

a film thickness detecting unit that detects a film thickness of the photosensitive layer of the photoreceptor;

an environment detecting unit that detects environment; and a contact area changing unit that changes a contact area between the contact charging roll and the photoreceptor based on detected results of the film thickness detecting unit and the environment detecting unit.

2. The image forming apparatus as claimed in claim 1, wherein the contact area changing unit has a contact area database providing relationship among the contact area, the film thickness and the environment, and changes the contact area between the contact charging roll and the photoreceptor by referring to the contact area database.

3. The image forming apparatus as claimed in claim 1, wherein upon changing the alternating current component, the contact area changing unit changes the contact area to make substantially constant a value of the alternating current component where the direct current component is saturated.

4. The image forming apparatus as claimed in claim 3, further comprising a bias control unit that controls the bias applied to the charging roll based on the value of the alternating current component where the direct current component is saturated.

5. The image forming apparatus as claimed in claim 1, wherein the contact area changing unit changes the contact area by changing a contact load between the charging roll and the photoreceptor.

6. The image forming apparatus as claimed in claim 1, wherein the contact area changing unit changes the contact area by changing a distance between axes of the charging roll and the photoreceptor.

7. An image forming apparatus comprising:

image carrying means provided with a photosensitive layer thereon for carrying an electrostatic latent image;

charging means, applied with a bias containing a direct current component having superimposed thereon an alternating current component, for contacting and charging the image carrying means to a predetermined potential;

film thickness detecting means for detecting a film thickness of the photosensitive layer of the image carrying means;

environment detecting means for detecting environment; and contact area changing means for changing a contact area between the charging means and the image carrying means based on detected results of the film thickness detecting means and the environment detecting means.

8. A charge control method comprising:

providing a photoreceptor that has on a surface thereof a photosensitive layer, in which an electrostatic latent image is formed, and a contact charging roll that is applied with a bias containing a direct current component having superimposed thereon an alternating current component, and charges the photoreceptor to a predetermined potential;

detecting a film thickness of the photosensitive layer of the photoreceptor;

detecting environment; and changing a contact area between the contact charging roll and the photoreceptor based on results of detecting the film thickness and the environment.

9. The charge control method as claimed in claim 8, wherein the changing the contact area between the contact charging roll and the photoreceptor is performed with reference to a contact area database providing relationship among the contact area, the film thickness and the environment.

10. The image forming apparatus as claimed in claim 8, wherein upon changing the alternating current component, the contact area is changed to make a value of the alternating current component substantially constant where the direct current component is saturated.

11. The image forming apparatus as claimed in claim 10, further comprising controlling the bias applied to the charging roll based on the value of the alternating current component where the direct current component is saturated.

12. The image forming apparatus as claimed in claim 8, wherein the contact area is changed by changing a contact load between the charging roll and the photoreceptor.

13. The image forming apparatus as claimed in claim 8, wherein the contact area is changed by changing a distance between axes of the charging roll and the photoreceptor.

* * * * *